US006685239B2

(12) United States Patent
Yamauchi et al.

(10) Patent No.: US 6,685,239 B2
(45) Date of Patent: Feb. 3, 2004

(54) VEHICLE DOOR OPENING CLOSING DEVICE

(75) Inventors: Nobuhiro Yamauchi, Chiryu (JP); Tokihiko Yamamoto, Nisshin (JP); Toshio Machida, Toyota (JP); Jun Kozuka, Takahama (JP)

(73) Assignees: Aisin Seiki Kabushiki Kaisha, Kariya (JP); Aisin Kiko Co., Ltd., Aichi-ken (JP)

( * ) Notice: Subject to any disclaimer, the term of this patent is extended or adjusted under 35 U.S.C. 154(b) by 0 days.

(21) Appl. No.: 10/080,534

(22) Filed: Feb. 25, 2002

(65) Prior Publication Data

US 2002/0117862 A1 Aug. 29, 2002

(30) Foreign Application Priority Data

Feb. 26, 2001 (JP) ..... 2001-050513

(51) Int. Cl.[7] ..... E05C 3/06

(52) U.S. Cl. ..... 292/201; 292/144; 292/216; 292/DIG. 23

(58) Field of Search ..... 292/201, 216, 292/144, DIG. 23; E05C 3/06

(56) References Cited

U.S. PATENT DOCUMENTS 6,131,337 A * 10/2000 Machida ..... 49/280
6,223,468 B1 * 5/2001 Kobayashi ..... 49/280
2001/0005079 A1 * 6/2001 Takamura ..... 292/201
2002/0030366 A1 * 3/2002 Swan ..... 292/201

FOREIGN PATENT DOCUMENTS

JP 62-101782 A 5/1987

* cited by examiner

*Primary Examiner*—J. J. Swann
*Assistant Examiner*—Carlos Lugo
(74) *Attorney, Agent, or Firm*—Burns, Doane, Swecker & Mathis, LLP

(57) ABSTRACT

A vehicle door opening-closing device which enables a reduction in the time for releasing a fully closed condition of the vehicle door without changing the driving force and the driving speed of the actuator when operating a vehicle door from a half closed condition to the fully closed condition and when releasing the fully closed condition. A latch mechanism includes a latch engageable with a striker and an engagement member for maintaining the latch at a condition for operating the vehicle door to the half closed condition and the fully closed condition. An operation mechanism operated by a motor operates the latch by way of a closing lever and operates the engagement member by way of an opening lever based on operation of an operation member. The opening lever possess a smaller lever ratio than the lever ratio of the closing lever.

23 Claims, 5 Drawing Sheets

VEHICLE DOOR OPENING CLOSING DEVICE

This application is based on and claim priority under 35 U.S.C. § 119 with respect to Japanese Application No. 2001-050513 filed on Feb. 26, 2001, the entire content of which is incorporated herein by reference.

FIELD OF THE INVENTION

This invention generally relates to a vehicle door opening and closing mechanism. More particularly, the present invention pertains to a vehicle door opening-closing device which includes a latch mechanism for maintaining a vehicle door at a half closed condition and at a fully closed condition engaged with a striker, an operation mechanism for fully closing the vehicle door and for releasing the closed door condition through operation of the latch mechanism, and an actuator for actuating the operation mechanism.

BACKGROUND OF THE INVENTION

A known vehicle door opening-closing device is disclosed in Japanese Patent Laid-Open Publication No. S62-101782. This known vehicle door opening-closing device includes two rods connected to two arms having approximately the same length and rotatable about a common rotation center with a rotation plate (i.e., an operation member). The rods are operated by the rotation of the rotation plate driven in both a normal direction and a reverse direction with one motor to thus operate a latch forming a part of the door lock mechanism.

When the motor is operated in the normal direction, one of the rods is operated to prepare for disengaging the striker of the vehicle door from the latch. In this condition, the vehicle door can be freely opened. When the motor is driven in the reverse direction, the other rod is operated to force the latch to rotate to a fully latched condition. Under the fully latched condition, the striker is engaged with the latch to fully close the vehicle door.

During closing operation, it is necessary to close the vehicle door against the compression reaction force of a weather strip provided between the vehicle door and a vehicle body in order to fully close the vehicle door. Thus, the latch requires a relatively large force to pull in the striker.

In the known vehicle door opening-closing device described above, to ensure a sufficiently large force, the reduction gear ratio between the motor and the rotation plate is increased to increase the torque on the rotation plate side. The greater the torque amount is increased, the smaller the moving amount of the rods per unit of rotational angle of the motor (i.e., the slower the moving speed of the rods becomes) and the greater the force of the latch for pulling in the striker.

Because the two arms in the aforementioned known vehicle door opening-closing device have approximately the same predetermined length, the door lock mechanism is operated with the same power in both the normal drive operation of the motor and the reverse drive operation of the motor. That is, the door lock mechanism is operated with a slow rod moving speed that is the same when fully closing the vehicle door as it is when it is operating to disengage the latch and the striker, notwithstanding that when the door lock mechanism is operated to release the engagement between the latch and the striker it is not necessary to operate against the compression reaction force of the weather strip. This lengthens the time from when the operation for opening the fully closed vehicle door is started until the time when the vehicle door is actually opened. This operation may be viewed by users as undesirable and annoying.

A need thus exists for a vehicle door opening-closing device which has a constant driving force of the actuator and the driving speed both when fully closing the vehicle door from the half closed condition and when releasing the fully closed condition and shortens the time for releasing the fully closed condition.

SUMMARY OF THE INVENTION

According to one aspect, a vehicle door opening-closing device includes a latch mechanism engageable with a striker for effecting a half closed condition of the vehicle door and a fully closed condition of the vehicle door, an operation mechanism operatively engageable with the latch mechanism at a point of force application to operate the latch mechanism during a closing operation from the half closed condition to the fully closed condition and during an opening operation to release the fully closed condition of the vehicle door, and an actuator for actuating the operation mechanism. The operation mechanism operates the latch mechanism with a smaller force and faster moving speed of the point of force application during the opening operation compared to during the closing operation under a driving force and a driving speed of the actuator that are approximately the same during release of the fully closed condition of the vehicle door and during movement of the vehicle door from the half closed condition to the fully closed condition.

According to another aspect, a vehicle door opening-closing device includes a latch mechanism engageable with a striker for effecting a half closed condition of the vehicle door and a fully closed condition of the vehicle door, a movable opening lever having a fulcrum and engageable with the latch mechanism at a first point of force application to operate the latch mechanism during an opening operation to release the fully closed condition of the vehicle door, and a movable closing lever having a fulcrum and engageable with the latch mechanism at a second point of force application to operate the latch mechanism during a closing operation to move the vehicle door from the half closed condition to the fully closed condition. The distance between the fulcrum of the opening lever and the first point of force application is greater than a distance between the fulcrum of the closing lever and the second point of force application. A motor produces an output to move the opening lever into engagement with the latch mechanism and to move the closing lever into engagement with the latch mechanism. The motor is operating under a driving force and a driving speed during release operation of the fully closed condition of the vehicle door that is the same as the driving force and the driving speed under which the motor is operated during movement of the vehicle door from the half closed condition to the fully closed condition.

In accordance with another aspect of the invention, a vehicle door opening-closing device includes a latch mechanism engageable with a striker and positionable in a half latched condition and a fully latched condition, a motor, an operation member operatively associated with the motor to move under driving operation of the motor, a movable opening lever having a fulcrum and a movable closing lever also having a fulcrum. The opening lever is adapted to be contacted by the operation member at a first contacting point to move the opening lever into contact with the latch mechanism at a first point of force application of the opening lever to operate the latch mechanism and effect release of the fully latched condition of the latch mechanism. The movable closing lever is adapted to be contacted by the operation member at a second contacting point to move the closing lever into contact with the latch mechanism at a second point of force application of the closing lever to operate the latch mechanism from the half latched condition to the fully latched condition. The opening lever possesses a lever ratio defined as a ratio of a distance between the fulcrum of the opening lever and the first contacting point relative to a distance between the fulcrum of the opening lever and the first point of force application. The closing lever possesses a lever ratio defined as a ratio of a distance between the fulcrum of the closing lever and the second contacting point relative to a distance between the fulcrum of the closing lever and the second point of force application. The lever ratio of the opening lever is less than the lever ratio of the closing lever.

BRIEF DESCRIPTION OF THE DRAWING FIGURES

The foregoing and additional features and characteristics of the present invention will be come more apparent form the following detained description considered with reference to the accompanying drawing figures in which like reference numerals designate like elements.

DETAILED DESCRIPTION OF THE INVENTION

A vehicle door opening-closing device according to one embodiment is illustrated in FIGS. 1–7. The vehicle door opening-closing device can be used in connection with, for example, a flip-up type backdoor of a vehicle (i.e., vehicle door) for opening and closing the vehicle door. The flip-up type backdoor has rather large dimensions and a relatively long external peripheral length. Thus, in general, the length of the weather strip disposed along the peripheral portion of the opening in the vehicle body is relatively long. With this relatively long weather strip, a relatively large force is required to fully close the backdoor from the condition in which the backdoor is not in the fully closed condition.

Figure 1:
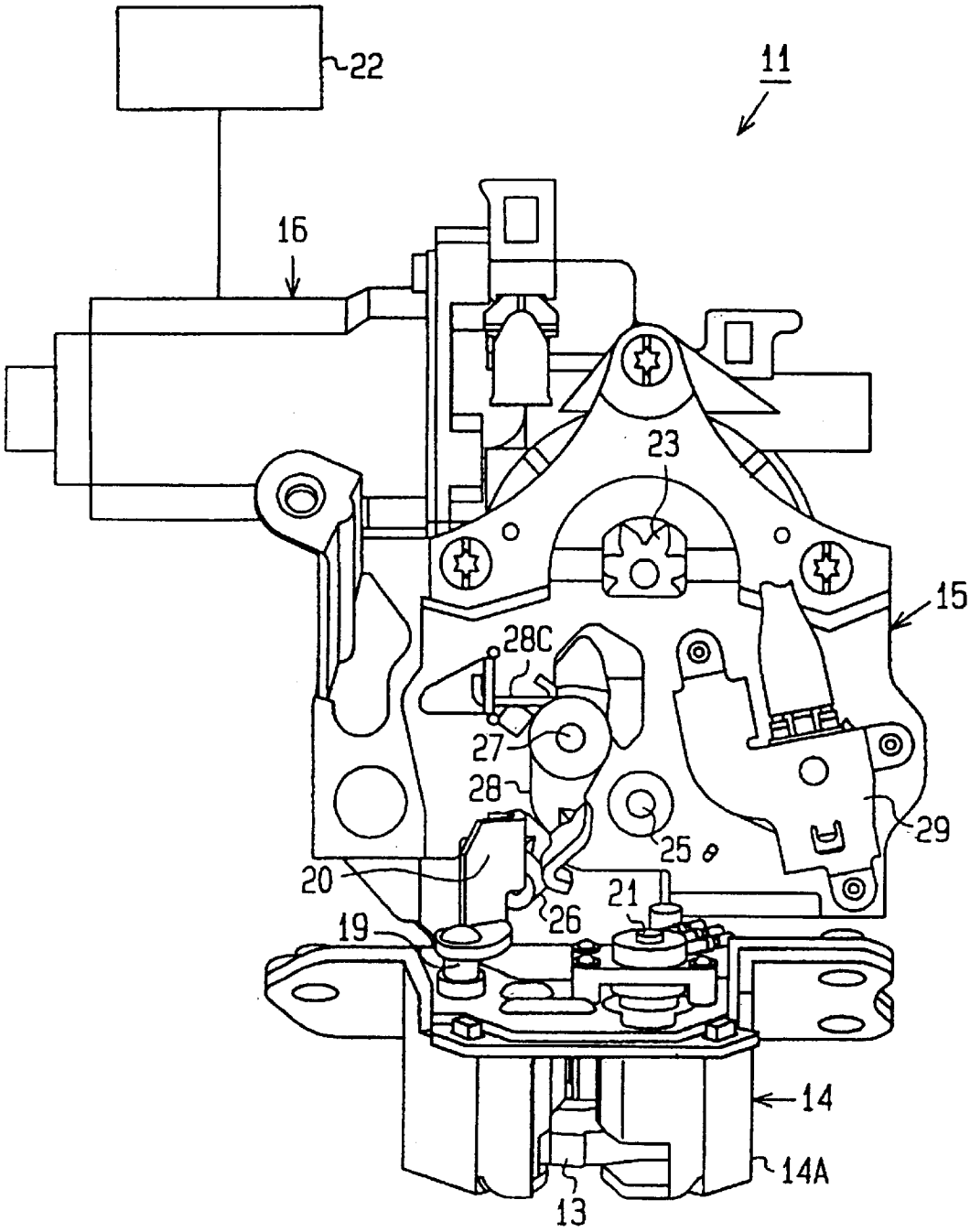
FIG. 1 is a front view of a vehicle door opening-closing device according to one disclosed embodiment.

As shown in FIG. 1, the vehicle door opening-closing device 11 includes a latch mechanism 14 having a latch 13 engageable with a striker 12 (shown in FIG. 3) that is fixed on the vehicle body opening side. The vehicle door opening-closing device 11 includes an operation mechanism 15 for operating the latch mechanism 14, a motor portion 16 functioning as an actuator for driving the operation mechanism 15, and a control device 22 for controlling the motor portion 16.

Figure 2:
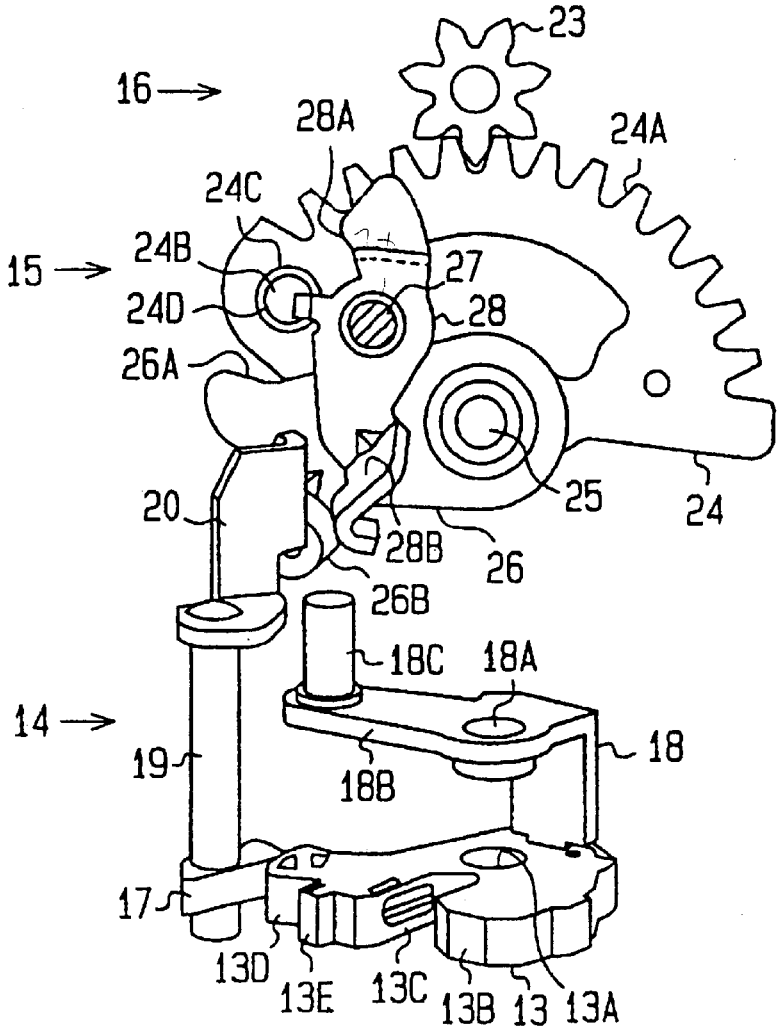
FIG. 2 is a perspective view of a main portion of the vehicle door opening-closing device under the condition that the operation gear is at an approximately neutral position.
Figure 3:
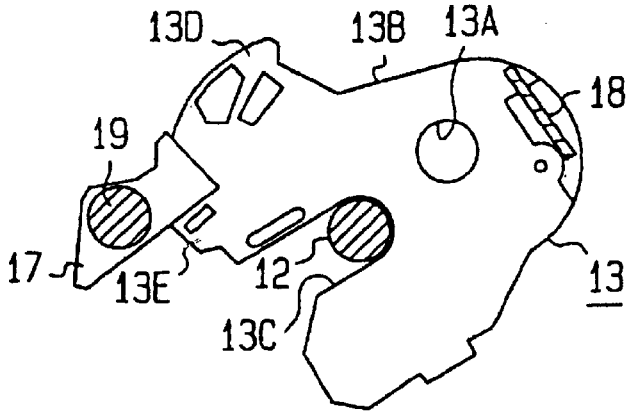
FIG. 3 is a plane view of the main portion of the latch mechanism.

FIGS. 2–6 show various operational states of the latch mechanism 14, the operation mechanism 15, and the motor portion 16. As shown in FIGS. 2–6, in addition to the latch 13, the latch mechanism 14 includes a engagement member 17 that is engageable with the latch 13. The latch 13 is pivotally supported by a housing 14A (shown in FIG. 1) of the latch mechanism 14 by way of a latch shaft inserted into a bore 13A formed on the latch 13. The latch 13 includes a U-shaped aperture 13C opening to the outer peripheral surface 13B of the latch. As illustrated in FIG. 3, a striker 12 is adapted to be introduced into the U-shaped aperture 13C in accordance with movement of the vehicle door resulting from manual operation. The latch 13 includes first and second engagement projections 13D, 13E projecting outwardly from the outer peripheral surface 13B of the latch and engageable with the engagement member 17.

A latch lever 18 is fixed to the latch 13 so that the latch 13 and the latch lever 18 are movable together. The latch shaft mentioned above is also positioned in a bore 18A formed in the latch lever 18. The latch lever 18 includes an arm portion 18B extending away from the rotational center of the latch 13. An engagement pin 18C is provided on the tip portion or end region of the arm portion 18B.

The latch mechanism 14 also includes an engagement member shaft 19 and an engagement member lever 20. The engagement member 17 is fixed to the engagement member shaft 19 which is positioned parallel to the latch shaft and pivotally supported by the housing 14A. The engagement member lever 20 is fixed to an upper end portion (i.e., upper end portion in FIGS. 2, 4, 6) of the engagement member shaft 19.

FIG. 3 illustrates the latch 13 and the engagement member 17 as seen from above. The latch 13 is biased in the counterclockwise direction of FIG. 3 by a spring (not shown). The engagement member 17 is biased in the clockwise direction of FIG. 3 by a spring. When the first engagement projection 13D of the latch 13 and the engagement member 17 are engaged while the striker 12 is positioned in the U-shaped aperture 13C (i.e., the half latched condition shown in FIG. 3), the vehicle door is at the half closed condition. When the second engagement projection 13E of the latch 13 and the engagement member 17 are engaged (i.e., the fully latched condition) while the striker 12 is positioned in the U-shaped aperture 13C, the vehicle door is at the fully closed condition.

When the engagement member 17 and the latch 13 are disengaged, either at the half latched condition or at the fully latched condition, the latch 13 is maintained at the open condition by contacting a stopper after rotating under the biasing force of the spring. When the latch 13 is at the open condition, the U-shaped aperture 13C can receive the striker 12 and can be separated from the striker 12 by the manual movement of the vehicle door. The engagement member 17 contacts a stopper (not shown) so as to be positioned at a location to be ready for being engaged with the latch 13 when the latch 13 is at the open condition.

The latch mechanism 14 includes a latch condition detecting switch 21 (hereinafter referred to as a latch switch) shown in FIG. 1 for detecting the positional condition of the latch 13. The latch switch 21 outputs a half latch signal (i.e., half latch ON condition) to a control device 22 shown in FIG. 1 when the latch 13 is positioned between the half latched condition and the fully latched condition. In practice, when the latch 13 is rotated from the open condition side toward the half latched condition side, the latch switch 21 is placed in the half latched ON condition immediately before the latch 13 reaches the half latched condition and maintains the half latch ON condition until reaching the fully latched condition. When the latch 13 is rotated from the fully latched condition side toward the half latched condition side, the half latched ON condition of the latch switch 21 is released or switched over to the latch OFF condition when the latch 13 exceeds or passes the position of the half latched condition moving toward the open condition side.

The latch switch 21 outputs a full latch signal to the control device 22 (i.e., full latch ON condition) when the latch 13 is at a position exceeding the fully latched condition. The latch switch 21 outputs the half latch signal and the full latch signal based on the positional condition of the latch 13, irrespective of the position of the striker 12, that is regardless of whether the striker 12 is being introduced into the U-shaped aperture 13C of the latch 13 or retracted from the U-shaped aperture 13C.

The motor portion 16 includes an output pinion gear 23 operatively connected to an electric motor via a reduction gear mechanism. The motor portion 16 is controlled by the control device 22. The output pinion gear 23 is rotated in both the normal direction and the reverse direction by the control of the control device 22. According to this embodiment, the motor portion 16 has equal output driving force in both the normal and the reverse rotational directions and the output driving speed of the output pinion gear 23 is equal in both the normal and reverse rotational directions.

The operation mechanism 15 includes an operation gear 24 serving as an operation member that is engaged with the output pinion gear 23. The operation gear 24 is pivotally supported by a gear shaft 25 which is not parallel with the latch shaft or the engagement member shaft 19 on which the engagement member 17 is mounted. The operation gear 24 has an approximately sector shape when viewed from the front and includes an arc shaped geared portion 24A engageable with the output pinion gear 23.

Figure 7:
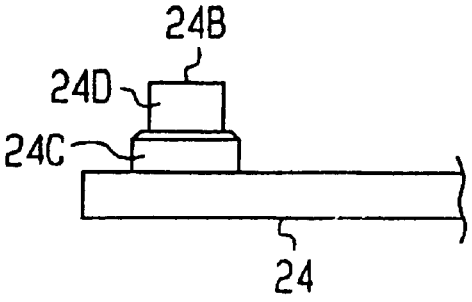
FIG. 7 is a partial enlarged side view of the operational pin used in the vehicle door opening-closing device.

An operation pin 24B is fixed by, for example, riveting on the surface of the operation gear 24 at one end side of the operation gear 24 at a position close to the outer periphery. As shown in FIG. 7, the operational pin 24B is provided with a larger diameter portion 24C and a smaller diameter portion 24D, with the larger diameter portion 24C having a diameter greater than the diameter of the smaller diameter portion 24D. The smaller diameter portion 24D is located at the tip end of the operational pin 24B while the larger diameter portion 24C is located at the base side of the operational pin 24 adjacent the surface of the operation gear 24 at which the operation pin 24B is fixed and from which the operation pin 24B extends.

The operation mechanism 15 also includes a closing lever 26 that is rotatably mounted on the gear shaft 25. The closing lever is provided with a contact portion 26A. The closing lever 26 is adapted to be rotated in the counterclockwise direction when the contact portion 26A of the closing lever 26 and the larger diameter portion 24C of the operation pin 24B contact one another during counterclockwise rotation of the operation gear 24.

The closing lever 26 also includes a closing operation member 26B that is adapted to contact the engagement pin 18C of the latch lever 18 upon counterclockwise rotation of the operation gear 24. When the closing lever 26 is further rotated in the counterclockwise direction while the closing operation member 26B is in contact with the engagement pin 18C, the latch 13 is rotated in the closing direction (i.e., moves in a direction from the open condition side toward the fully latched condition side). When the closing lever 26 is not contacted by the operation pin 24B, the closing lever 26 is biased in the clockwise direction by a spring (not illustrated) and is maintained at a predetermined position by contacting a stopper (not illustrated).

The operation mechanism 15 further includes an opening lever 28. The opening lever 28, the closing lever 26 and the operation gear 24 are arranged such that the closing lever 26 is positioned between (i.e., generally sandwiched between) the operation gear 24 and the opening lever 28. The opening lever 28 is rotatably supported by a lever shaft 27 that is arranged parallel with the gear shaft 25. The lever shaft 27 and the gear shaft 25 are thus spaced apart from one another. The opening lever 28 is rotated in the clockwise direction through contact of a contact portion 28A of the opening lever 28 by the small diameter portion 24D of the operation pin 24B during clockwise rotation of the operation gear 24.

The opening lever 28 includes an opening operation member 28B for contacting an engagement member lever 20 that is fixed to the engagement member shaft 19. The opening operation member 28B is positioned on the side of the lever shaft 27 opposite the contact portion 28A. In the illustrated embodiment, the opening operation member 28B is positioned generally diametrically opposite the contact portion 28A. The opening operation member 28B is adapted to contact the engagement member lever 20 during clockwise rotation of the opening lever 28 by the operation gear 24. When the opening lever 28 is further rotated in the clockwise direction while the opening operation member 28B is in contact with the engagement member lever 20, the engagement member 17 is rotated in the direction for releasing the engagement with the latch (i.e., the counterclockwise direction of FIG. 3). When the opening lever 28 is not contacted by the operation pin 24B, the opening lever 28 is biased in the counterclockwise direction by a spring 28C shown in FIG. 1 and is maintained at a predetermined position by contacting a stopper (not shown).

The lever ratio of the opening lever 28 is less than the lever ratio of the closing lever 26. The lever ratio of the opening lever 28 is defined as the ratio of a first distance relative to a second distance, wherein the first distance represents the straight-line distance between the contacting point (i.e., power point) at which the contact portion 28A is contacted by the operation pin 24B and a center point (i.e., fulcrum) of the lever shaft 27, and the second distance represents the straight-line distance between the contacting point (i.e., point of force application) at which the opening operation member 28B contacts the engagement member lever 20 and the fulcrum. The lever ratio of the closing lever 26 is defined as the ratio of a third distance relative to a fourth distance, wherein the third distance represents the straight-line distance between the contacting point (i.e., power point) at which the contact portion 26A is contacted by the operation pin 24B and the center point (i.e., fulcrum) of the gear shaft 25, and the fourth distance represents the straight-line distance between the contacting point (i.e., point of force application) at which the closing operation member 26B contacts the engagement pin 18C and the fulcrum.

According to this illustrated and described embodiment of the vehicle door opening-closing device 11, a neutral position of the operation gear 24 is defined as the condition in which the operation pin 24B and the closing lever 26 and opening lever 28 do not affect one another respectively. The control device 22 controls the motor portion 16 to actuate the operation gear 24 at the neutral position. Whether the operation gear 24 is at the neutral position is detected by a neutral position detection switch 29 shown in FIG. 1 which is provided in the operation mechanism 15.

When the operation gear 24 is at the neutral position, a predetermined distance is ensured between the operation pin 24B and the contact portion 26A, and between the operation pin 24B and the contact portion 28A. When the operation gear 24 is rotated greater than a predetermined angle, the operation pin 24B and the contact portion 26A, and the operation pin 24B and the contact portion 28A come in contact with each other, respectively.

The operation of the vehicle door opening-closing device 11 constructed in the foregoing manner is as follows. FIG. 2 shows the condition in which the vehicle door is open, the latch 13 is under the open condition, and the operation gear 24 is at the neutral position. When the latch 13 is rotated in the closing direction by the striker 12 that is introduced into the U-shaped aperture 13C by a manual door closing operation, the latch 13 comes under the half latched condition shown in FIG. 3 by the engagement between the second engagement projection 13E and the engagement member 17.

In this case, through switching of the latch switch 21 to the half latch ON condition, the control device 22 controls the actuation of the motor portion 16 for rotating the operation gear 24 in the counterclockwise direction from the neutral position. Thus, the operation gear 24 starts to rotate. When the rotation angle of the operation gear 24 reaches the predetermined angle, the larger diameter portion 24C of the operation pin 24B contacts the contact portion 26A of the closing lever 26 to rotate the closing lever 26.

Figure 4:
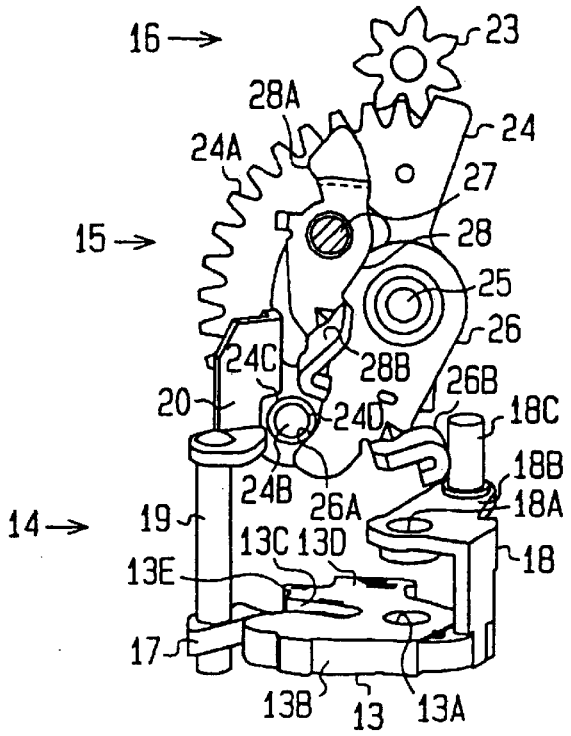
FIG. 4 is a perspective view of the main portion of the vehicle door opening-closing device in one operational position.
Figure 5:
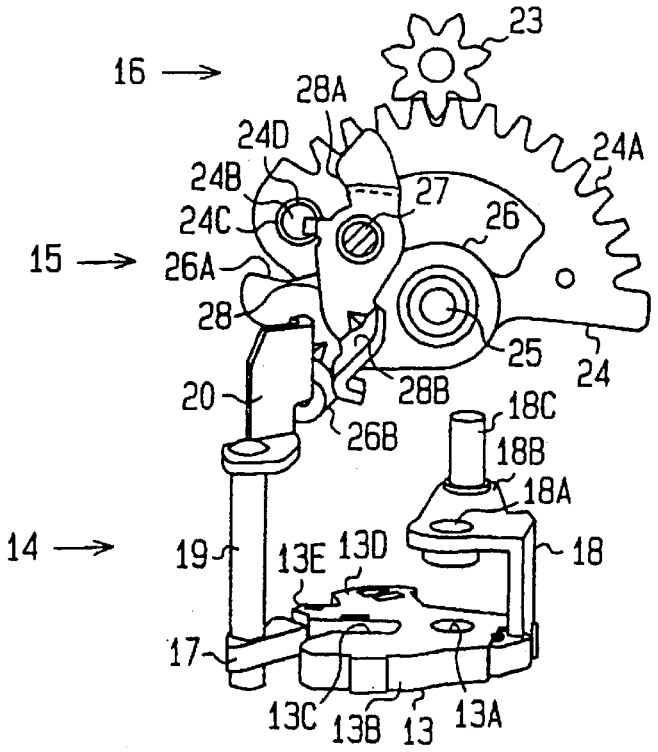
FIG. 5 is a perspective view of the main portion of the vehicle door opening-closing device in another operational position.

As shown in FIG. 4, when the closing lever 26 is further rotated after the rotation angle of the closing lever 26 reaches the predetermined angle, the closing operation member 26B contacts the encasement pin 18C for rotating the latch 13 toward the full latch condition side. The striker 12 is thus pulled in so that the vehicle door moves to the fully closed condition by virtue of the rotation of the latch 13. In this case, the latch 13 pulls in the striker 12 with a sufficiently large force by the closing lever 26 whose lever ratio is predetermined to be relatively large.

When the latch 13 reaches the position exceeding the full latch condition in which the vehicle door can be maintained at the fully closed condition, the latch switch 21 becomes the full latch ON condition. The engagement between the second engagement projection 13E and the engagement member 17 is ensured because the motor portion 16 is actuated to rotate the latch 13 until the latch switch 21 becomes the full latch ON condition.

Then, the control device 22 controls the motor portion 16 for reversing the operation gear 24 to return to the neutral position. Thus, the second engagement projection 13E and the engagement member 17 are securely engaged and the latch 13 is in the fully latched condition. In addition, the closing operation member 26B and the engagement pin 18C are disengaged to reduce excessive stress affecting the latch mechanism 14 and the operation mechanism 15 (i.e., the condition shown in FIG. 5).

When the operation gear 24 is rotated to the neutral position, the control device 22 stops the actuation of the motor portion 16 in order to stop the operation or movement of the gear 24 by virtue of the detection signal issued from the neutral position detection switch 29. In this case, the operation gear 24 stops at a position slightly exceeding the neutral position due to the time lag of the control by the control device 22, and the mechanical inertia of the motor portion 16 and the operation gear 24. At the position slightly exceeding neutral position, because the opening operation member 28B has not interfered with or contacted the detent member lever 20, the engagement member 17 is not operated to be opened even if the operation pin 24B contacts the contact portion 28A of the opening lever 28.

When a switch is operated by the user for opening the vehicle door (i.e., releasing the fully closed condition) under the foregoing condition, the control device 22 starts to control the motor portion 16 for rotating the operation gear 24 in the clockwise direction from the neutral position. Thus, the operation gear 24 starts rotating. When the rotation angle of the operation gear 24 reaches the predetermined angle, the small diameter portion 24D of the operation pin 24B contacts the contact portion 28A of the opening lever 28 to start the rotation of the opening lever 28.

Figure 6:
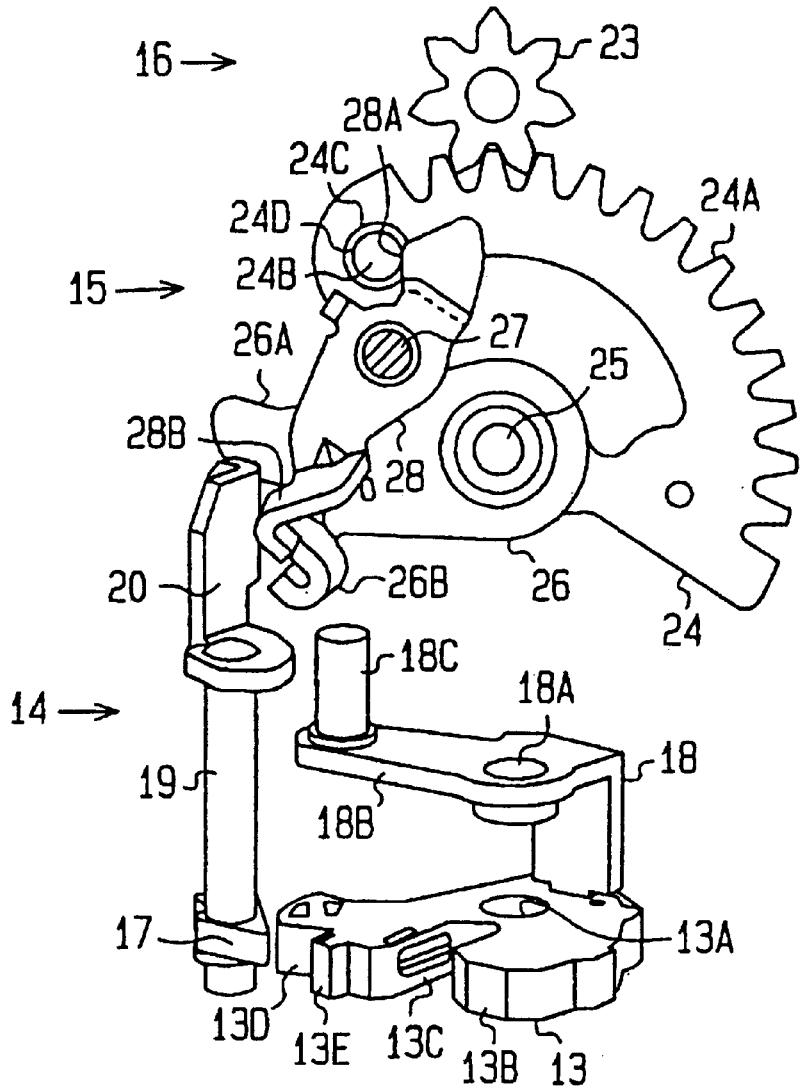
FIG. 6 is a perspective view of the main portion of the vehicle door opening-closing device in another operational position.

As shown in FIG. 6, when the opening lever 28 is further rotated after the rotation angle of the opening lever 28 reaches the predetermined angle, the opening operation member 28B contacts the detent member lever 20 for rotating the engagement member 17 to effect disengagement from the latch 13. The engagement member 17 and the latch 13 are disengaged by the rotation of the engagement member 17. The latch 13 is thus rotated toward the open condition side due to the biasing force of the spring and the restoring force of the weather strip. Thus, the striker 12 becomes retractable from the U-shaped aperture 13C and the vehicle door can be released from the fully closed condition. The engagement member 17 is swiftly rotated by the opening lever 28 whose lever ratio is predetermined to be relatively small for swiftly releasing the engagement with the latch 13.

When the latch 13 is operated from the full latch condition to the open condition, the latch switch 21 is changed to the half latch OFF condition in which the half latch ON condition is canceled. Accordingly, the control device 22 controls the motor portion 16 for reversing the operation gear 24 to return to the neutral position.

When the operation gear 24 is rotated to the neutral position, the control device 22 stops the actuation of the motor portion 16 in order to stop the operation gear 24 by virtue of the detection signal from the neutral position detection switch 29 (i.e., the condition shown in FIG. 2). In this case, like that described above, the operation gear 24 is stopped at a position slightly exceeding the neutral position. At this position, because the closing operation member 26B has not interfered with or contacted the engagement pin 18C, the latch 13 is not closed again even if the operation pin 24B contacts the contact portion 26A of the closing lever 26.

By virtue of the construction and operation described above in connection with this disclosed and illustrated embodiment, several advantages can be realized. For example, the operation mechanism 15 operates the latch mechanism 14 with a smaller force at the opening operation for releasing the fully closed condition compared to that at the closing operation for operating the vehicle door from the half closed condition to the fully closed condition. The operation mechanism 15 also operates the latch mechanism 14 with a faster moving speed of the point of application of force of the operation mechanism 15 relative to the latch 13. Accordingly, the time associated with releasing the vehicle door from the fully closed condition can be shortened.

In addition, the operation mechanism 15 includes the opening lever 28 for opening operation whose lever ratio is relatively smaller, and the closing lever 26 for closing operation whose lever ratio is relatively larger. Accordingly, the moving speed of the point of application of force relative to the latch mechanism 14 side during the opening operation can be larger than at the closing operation without changing the moving speeds of the power point of the levers 26, 28 from each other.

The opening lever 28 and the closing lever 26 have different rotational centers positioned at the different positions. Accordingly, the respective lever ratios of the opening lever 28 and the closing lever 26 can be relatively easily set to be different from one another in this embodiment in which the closing lever 26 and the opening lever 28 are operated by a common operation pin 24B.

Additionally, in this embodiment of the vehicle door opening-closing device, the closing lever 26 which receives a relatively large reaction force from the latch 13 side during the closing operation is adapted to contact the larger diameter portion 24C at the base end side of the operation pin 24B, while the opening lever 28 which receives a relatively small reaction force from the engagement member 17 side during the opening operation is adapted to contact the small diameter portion 24D at the tip end side of the operation pin 24B. With this construction, because the relatively large force affects or acts on the portion close to the connecting portion (i.e., fixing portion) at which the operation pin 24B is fixed to the operation gear 24, the fixing portion is unlikely to become loosened and the operation pin 24B is unlikely to become bent.

Also, because the tip end side of the operation pin 24B constitutes the smaller diameter portion 24D whose diameter is relatively smaller, the space can be effectively used around the moving locus on the tip end side of the operation pin 24B.

Further, the latch mechanism 14 is provided on the vehicle door and the striker 12 is provided on the vehicle body which supports the vehicle door. This makes it easier to provide the control device 22 which is electrically connected to the motor portion 16, in addition to the operation mechanism 15 which mechanically connected to the latch mechanism 14 and the motor portion 16. That is, it becomes easier to provide a lock release operation switch which is required to be connected to the control device 22 in the vehicle door.

It is to be understood that various changes or alternatives can be incorporated into this embodiment of the vehicle door opening-closing device. For example, the closing lever 26 may be formed as one unit with the operation gear 24. In this case, the spring for biasing the closing lever 26 in the clockwise direction in FIG. 2 would not be required, thus reducing the number of parts.

Also, the operation pin 24B need not be specifically constructed with the larger diameter portion 24C and the smaller diameter portion 24D whose diameters are different from each other. In this regard, the diameter of the operation pin 24B may be configured to have one diameter size (i.e., a constant diameter along its length).

Although the rotation center of the closing lever 26 and the rotation center of the opening lever 28 are positioned at different positions, the closing lever 26 and the opening lever 28 may have a common rotation center. With such an alternative construction, the number of shafts associated with the different rotational centers can be reduced.

Figure 8:
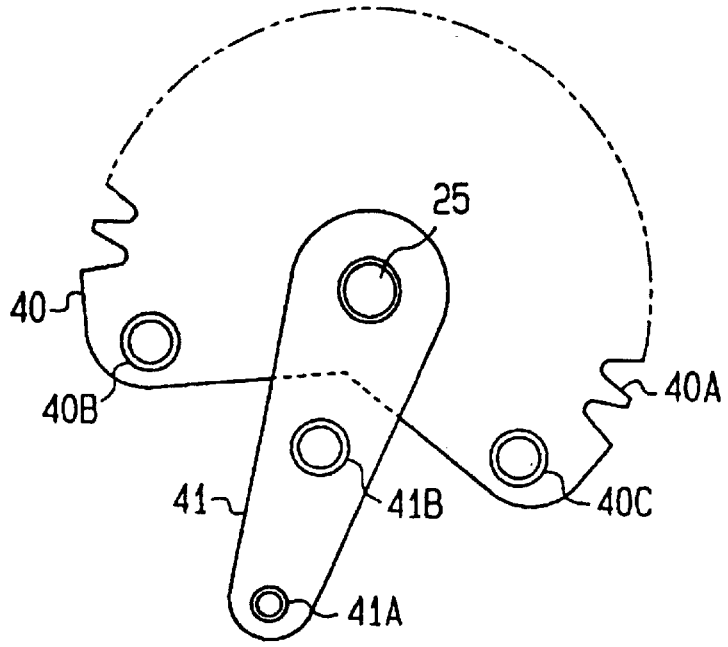
FIG. 8 is a front view of the operation gear and the common opening lever and closing according to a modified embodiment.

The embodiment described above and illustrated in FIGS. 1–7 utilizes a closing lever 26 and an opening lever 28 having different lever ratios and defining two separate levers. In place of this construction, a common opening lever and closing lever whose lever ratio during the opening operation is smaller than the lever ratio during the closing operation may be employed. The common opening and closing lever defines an opening lever and a closing lever that are integrated together as a single unit. The construction of such a common opening and closing lever may be, for example, such as shown in FIG. 8. In this construction, in place of the operation gear 24, a sector operation gear 40 is extended in the peripheral direction to increase the number of gear at the geared portion 40A. Two operation pins 40B, 40C are fixedly provided, via riveting, on the surface of the operation gear 40 and are positioned at the circumferential end portions of the sector operation gear 40 at the outer peripheral side of the operation gear 40.

In place of the closing lever 26, a common opening and closing lever 41 is rotatably supported on the gear shaft 25 which corresponds to the rotation center of the operation gear 40. The common lever is rotatably supported independently of the operation gear 40. An opening pin 41A is provided on the tip end of the common lever 41 for opening and closing. In addition, a closing pin 41B is fixedly provided, via riveting, on the common opening and closing lever 41 at a position between the opening pin 41A and the gear shaft 25.

When the operation gear 40 is rotated in the counterclockwise direction by the rotation of the output pinion gear 23, the common opening and closing lever 41 contacts the operation pin 40B for rotating the common lever 41 in the counterclockwise direction. By continuing this rotation, the closing pin 41B is engaged with the engagement pin 18C for further pressing the latch 13 to rotate in the closing direction. In this case, the portion of the common lever 41 on the tip end side relative to the closing pin 41B and the opening pin 41A do not interfere with other members such as the latch lever 18 and the latch 13.

On the other hand, when the operation gear 40 is rotated in the clockwise direction by the rotation of the output pinion gear 23, the operation pin 40C contacts the common opening and closing lever 41 for rotating the common opening and closing lever 41 in the clockwise direction. By continuing this rotation, the opening pin 41A is engaged with the detent member lever 20 for pressing the engagement member 17 to be rotated in the direction to be disengaged from the latch 13.

Although the operation gear 24 (i.e., the operation member) is rotated in both the clockwise and counterclockwise directions by the motor portion 16 as described above, the operation member may be rotated in only one direction. In this case, for example, the construction shown in FIG. 9 may be employed. According to this alternative construction, an opening cam lever 50 possessing a smaller lever ratio and a closing cam lever 51 possessing a larger lever ratio are rotatably supported independently of each other at a common rotation center 52 serving as a fulcrum. A point 50A of force application of the opening cam lever 50 rotates the engagement member 17 for releasing the engagement with the latch 13 by contacting the detent member lever 20. The point 51A of force application of the closing cam lever 51 rotates the latch 13 in the closing direction by contacting the engagement pin 18C. The portion of the opening cam lever 50 located on the opposite side of the point 50A of force application and the point of force application of force 51A relative to a rotation center 52 on the opening cam lever 50 and the closing cam lever 51 are positioned to be able to engage with a rotation cam 53 as an operation member. The opening cam lever 50 and the closing cam lever 51 are operated by the rotation of the rotation cam 53 in one direction to perform both the rotation for operating the engagement member 17 and the rotation for operating the latch 13. According to this construction, a rotation reference position is defined when a tip portion 53A projecting in the radial direction from the rotation cam 53 is positioned on a line L connecting a rotation center 54 of the rotation cam 53 and the common rotation center 52 of the opening cam lever 50 and the closing cam lever 51. This rotation reference position corresponds to the neutral position. That is, the rotation cam 53 is rotated in one direction by 180 degrees from the rotation reference position.

When the rotation cam 53 is rotated so that the tip end portion 53A is moved from the rotation reference position toward the closing cam lever 51 side by the rotation of the rotation cam 53, and the engagement point (i.e., power point) between the rotation cam 53 and the closing cam lever 51 moves away from the rotation center 54 (i.e., away from the line L), the closing cam lever 51 rotates the latch 13 in the aforementioned manner. (i.e., the condition of FIG. 9). When the rotation cam 53 is rotated so that the tip portion 53A is moved from the rotation reference position toward the opening cam lever 50 side, and the engagement point (i.e., power point) between the rotation cam 53 and the opening cam lever 50 moves away from the rotation center 54 (i.e., away from the line L), the opening cam lever 50 rotates the engagement member 17 in the aforementioned manner. With this construction, it is not necessary to operate the motor portion 16 for bi-directional rotation to actuate the rotation cam 53.

Figure 9:
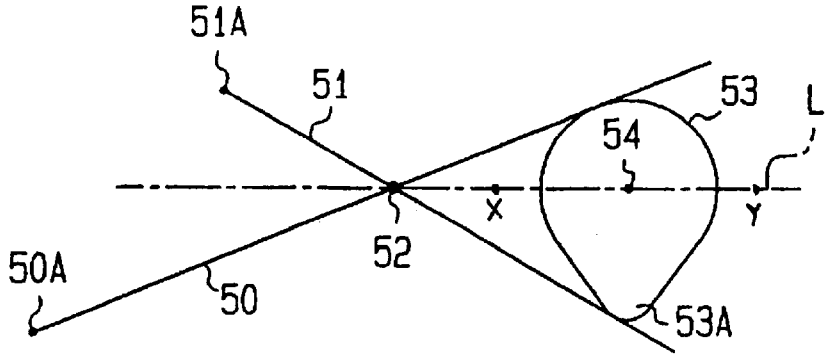
FIG. 9 is a schematic illustration of the operation mechanism portion according to another modified embodiment.

Thus, by way of example, during closing operation of the vehicle door, the tip portion 53A of the rotation cam 53 can be positioned at the neutral position (e.g., point X in FIG. 9). The rotation cam 53 is then rotated counterclockwise through 180° so that the tip end portion 53A of the rotation cam 53 is positioned at point Y as shown in FIG. 9. This rotation of the rotation cam 53 causes operation of the closing cam lever 51, whereupon the latch mechanism is moved from the half latched condition to the fully latched condition. To release the fully latched condition of the latch mechanism, the rotation cam 53 is rotated 180° in the counterclockwise direction so that the tip end portion 53A moves from point Y to point X. During this rotation of the rotation cam 53, the opening lever 50 is operated to release the fully latched condition of the latch mechanism.

The striker 12 may be provided on the vehicle door and the latch mechanism 14 may be provided on the vehicle body which supports the vehicle door. According to this construction, the motor portion 16 for operating the latch mechanism 14 via the operation mechanism 15 can be disposed on the vehicle body side in which a battery is typically provided. Thus, the wiring for electrical connection between the battery and the motor portion 16 can be simplified.

Although the description set forth above mentions that the vehicle door opening and closing device can be applied to a flip-up type backdoor, the vehicle door opening and closing device can be utilized in connection with other types of vehicle doors such as swing type vehicle doors having a hinge (including side doors) and sliding type doors.

It is also to be understood that the motor portion 16 may be have a different output driving force and output driving speed during rotation in the normal direction and in the reverse direction.

With the vehicle door opening-closing device described above, the time for releasing the fully closed condition of the door can be shortened without changing the driving force and the driving speed of the actuator during operation of the vehicle door from the half closed condition to the fully closed condition relative to releasing the fully closed condition. That is, utilizing the same driving force and driving speed of the of the actuator during operation of the vehicle door from the half closed condition to the fully closed condition and during release operation of the door from the fully closed condition, it is nevertheless possible to shorten the time for releasing the fully closed condition of the door.

The latch mechanism is operable with a faster moving speed of the point of force application relative to the latch mechanism of the operation mechanism and with the smaller force compared to at the closing operation at the opening operation of the vehicle door. Accordingly, the time for releasing the fully closed condition of the vehicle door can be reduced.

The vehicle door opening-closing device described above employs the operation mechanism having a closing lever and an opening lever which possess different lever ratios. By defining the lever ratio for the opening lever to be smaller than the lever ratio for the closing lever, the moving speed of the point of force application to the latch mechanism side during the opening operation can be greater than during the closing operation, without requiring that the motor operate at different speeds for effecting different moving speeds of the power point of the opening and closing levers. By positioning the rotation centers for the opening and closing levers at different positions, the lever ratios of the opening and closing levers can be set different from each other while at the same time operating both levers with a common member.

As described above, the contacting portion at which the closing lever and the operation pin contact one another is at the larger diameter portion of the pin which has a larger diameter and which is provided at the base end side close to the fixing portion of the operation pin. According to this construction, even with the operation mechanism being constructed so that reaction force from the closing lever to the operation pin is larger during the closing operation, the fixing portion at which the operation pin is fixed to the operation member is unlikely to become loosened and the operation pin is unlikely to fall off or be bent. Also, because the tip portion of the operation pin which corresponds to the portion of the pin that contacts the opening lever is a smaller diameter portion, the space around the moving locus on the tip end side of the operation pin can be efficiently used and effectively increased.

The principles, preferred embodiments and modes of operation of the present invention have been described in the foregoing specification. However, the invention which is intended to be protected in not to be construed as limited to the particular embodiment disclosed. Further, the embodiment described herein is to be regarded as illustrative rather than restrictive. Variations and changes may be made by others, and equivalents employed, without departing from the spirit of the present invention Accordingly, it is expressly intended that all such variations, changes and equivalents which fall within the apart and scope of the present invention as defined in the claims, be embraced thereby.

What is claimed is:

1. A vehicle door opening-closing device comprising:

a latch mechanism engageable with a striker for effecting a half closed condition of a vehicle door and a fully closed condition of the vehicle door;

an operation mechanism operatively engageable with the latch mechanism at a point of force application to operate the latch mechanism during a closing operation from the half closed condition to the fully closed condition and during an opening operation to release the fully closed condition of the vehicle door;

an actuator for actuating the operation mechanism;

the operation mechanism operating the latch mechanism with a faster moving speed at the point of force application during the opening operation compared to during the closing operation under a driving speed of the actuator that is substantially the same during release of the fully closed condition of the vehicle door and during movement of the vehicle door from the half closed condition to the fully closed condition; and wherein the operation mechanism includes an opening lever and a closing lever each possessing a lever ratio, the lever ratio of the opening lever being smaller than the lever ratio of the closing lever.

2. The vehicle door opening-closing device according to claim 1, wherein:

the operation mechanism includes an operation member driven by the actuator, an opening lever having a fulcrum and a closing lever having a fulcrum, the opening lever receiving a force from the operation member at a first power point to operate the opening lever and applying a force to the latch mechanism at a first point of force application, the closing lever receiving a force from the operation member at a second power point to operate the closing lever and applying a force to the latch mechanism at a second point of force application;

a distance between the power point and the fulcrum of each lever relative to a distance between the point of force application and the fulcrum of each lever being defined as a lever ratio; and the lever ratio of the opening lever being smaller than the lever ratio of the closing lever.

3. The vehicle door opening-closing device according to claim 2, wherein the opening lever and the closing lever each have a rotation center, the rotation center of the opening lever being spaced from the closing lever.

4. The vehicle door opening-closing device according to claim 2, wherein the operation mechanism further comprises:

an operation member for operating the opening lever and the closing lever, the operation member including an operation pin engageable with the opening lever and the closing lever for operating the opening lever and the closing lever, the operation pin including a smaller diameter portion positioned at a tip end of the operation pin and adapted to engage the opening lever, and a larger diameter portion located at a base end of the operation pin and adapted to engage the closing lever.

5. The vehicle door opening-closing device according to claim 1, wherein the operation mechanism further comprises:

an operation member receiving an output from the actuator, the operation member including an operation pin;

an opening lever operated during the opening operation and including a first point of force application at which the opening lever applies a force to the latch mechanism to operate the latch mechanism and a first power point at which a portion of the operation pin applies a force to the opening lever to operate the opening lever;

a closing lever operated during the closing operation and including a second point of force application at which the closing lever applies a force to the latch mechanism to operate the latch mechanism and a second power point at which a different portion of the operation pin applies a force to the closing lever to operate the closing lever;

a first shaft about which the opening lever is rotated, the first shaft including a first fulcrum;

a second shaft about which the closing lever is rotated, the second shaft including a second fulcrum;

the first point of force application of the opening lever contacting a portion of the operating pin; and the second point of force application of the closing lever contacting a different portion of the operating pin.

6. The vehicle door opening-closing device according to claim 5, wherein the opening lever has a first lever ratio defined as a distance between the first power point and the first fulcrum relative to a distance between the first point of force application and the first fulcrum, the closing lever having a second lever ratio defined as a distance between the second power point and the second fulcrum relative to a distance between the second point of force application and the second fulcrum, the first lever ratio being smaller than the second lever ratio.

7. The vehicle door opening-closing device according to claim 6, wherein the operation pin includes a smaller diameter portion and a larger diameter portion, the first point of force application of the opening lever contacting smaller diameter portion of the operating pin, and the second point of force application of the closing lever contacting the larger diameter portion of the operating pin.

8. The vehicle door opening-closing device according to claim 5, wherein the operation pin includes a smaller diameter portion and a larger diameter portion, the first point of force application of the opening lever contacting smaller diameter portion of the operating pin, and the second point of force application of the closing lever contacting the larger diameter portion of the operating pin.

9. The vehicle door opening-closing device according to claim 2, wherein the opening lever and the closing lever are mechanically formed as one unit.

10. A vehicle door opening-closing device according to claim 2, wherein the fulcrum for the opening lever and the fulcrum for the closing lever are the same.

11. A vehicle door opening-closing device according to claim 2, wherein the operation mechanism includes a rotation cam rotatable in one direction for operating the opening lever and the closing lever.

12. A vehicle door opening-closing device comprising:

a latch mechanism engageable with a striker for effecting a half closed condition of the vehicle door and a fully closed condition of the vehicle door;

a movable opening lever engageable with the latch mechanism at a first point of force application to operate the latch mechanism during an opening operation to release the fully closed condition of the vehicle door, the opening lever including a fulcrum;

a movable closing lever engageable with the latch mechanism at a second point of force application to operate the latch mechanism during a closing operation to move the vehicle door from the half closed condition to the fully closed condition, the closing lever including a fulcrum;

a distance between the fulcrum of the opening lever and the first point of force application being greater than a distance between the fulcrum of the closing lever and the second point of force application;

a motor producing an output to move the opening lever into engagement with the latch mechanism and to move the closing lever into engagement with the latch mechanism, the motor operating under a driving force and a driving speed during release operation of the fully closed condition of the vehicle door that is the same as the driving force and the driving speed under which the motor is operated during movement of the vehicle door from the half closed condition to the fully closed condition.

13. The vehicle door opening-closing device according to claim 12 wherein the operation mechanism includes an operation member driven by the motor, the operation member being engageable with the opening lever at a first power point to operate the opening lever and being engageable with the closing lever at a second power point to operate the closing lever, a distance between the first power point and the fulcrum of the opening lever relative to a distance between the first point of force application and the fulcrum of the opening lever defining a first lever ratio, a distance between the second power point and the fulcrum of the closing lever relative to a distance between the second point of force application and the fulcrum of the closing lever defining a second lever ratio, the lever ratio being smaller than the second lever ratio.

14. The vehicle door opening-closing device according to claim 13, wherein the operation member is a rotation cam, the motor driving the rotation cam in one direction during the release operation of the fully closed condition of the vehicle door and during movement of the vehicle door from the half closed condition to the fully closed condition.

15. The vehicle door opening-closing device according to claim 13, wherein the operation member includes an operation pin, one portion of the operation pin contacting the opening lever during the opening operation and another portion of the operation pin contacting the closing lever during the closing operation.

16. The vehicle door opening-closing device according to claim 12, wherein the fulcrum of the opening lever and the fulcrum of the closing lever are spaced apart from one another.

17. The vehicle door opening-closing device according to claim 12, wherein the fulcrum of the opening lever and the fulcrum of the closing lever are the same.

18. The vehicle door opening-closing device according to claim 12, wherein the opening lever and the closing lever are formed by a common opening and closing lever, the common opening and closing lever including an opening pin which engages the latch mechanism during the opening operation and a closing pin which engages the latch mechanism during the closing operation.

19. A vehicle door opening-closing device comprising:

a latch mechanism engageable with a striker and positionable in a half latched condition and a fully latched condition;

a motor;

an operation member operatively associated with the motor to move under driving operation of the motor;

a movable opening lever having a fulcrum, the opening lever being adapted to be contacted by the operation member at a first contacting point to move the opening lever into contact with the latch mechanism at a first point of force application of the opening lever to operate the latch mechanism and effect release of the fully latched condition of the latch mechanism;

a movable closing lever having a fulcrum, the closing lever being adapted to be contacted by the operation member at a second contacting point to move the closing lever into contact with the latch mechanism at a second point of force application of the closing lever to operate the latch mechanism from the half latched condition to the fully latched condition;

the opening lever having a lever ratio defined as a ratio of a distance between the fulcrum of the opening lever and the first contacting point relative to a distance between the fulcrum of the opening lever and the first point of force application;

the closing lever having a lever ratio defined as a ratio of a distance between the fulcrum of the closing lever and the second contacting point relative to a distance between the fulcrum of the closing lever and the second point of force application; and the lever ratio of the opening lever being less than the lever ratio of the closing lever.

20. The vehicle door opening-closing device according to claim 19, wherein the operation member includes an operation pin, one portion of the operation pin contacting the opening lever at the first contacting point and another portion of the operation pin contacting the closing lever at the second contacting point.

21. The vehicle door opening-closing device according to claim 19, wherein the fulcrum of the opening lever and the fulcrum of the closing lever are spaced apart from one another.

22. The vehicle door opening-closing device according to claim 19, wherein the fulcrum of the opening lever and the fulcrum of the closing lever are the same.

23. The vehicle door opening-closing device according to claim 19, wherein the opening lever and the closing lever are formed by a common opening and closing lever, the common opening and closing lever including an opening pin constituting the first contacting portion of the opening lever and a closing pin constituting the second contacting portion of the closing lever.

* * * * *